United States Patent [19]

Osanai

[11] 4,197,636

[45] Apr. 15, 1980

[54] METHOD OF PRODUCING A STRUCTURE OF CONNECTION TERMINALS

[75] Inventor: Akira Osanai, Hachioji, Japan

[73] Assignee: Olympus Optical Co., Ltd., Tokyo, Japan

[21] Appl. No.: 800,546

[22] Filed: May 25, 1977

[30] Foreign Application Priority Data

Jun. 1, 1976 [JP] Japan ..... 51/63926

[51] Int. Cl.[2] ..... H01R 9/04

[52] U.S. Cl. ..... 29/882; 29/883; 29/884

[58] Field of Search ..... 29/630 R, 630 A, 630 B, 29/629, 418, 630 G, 626, 628; 339/17 B, 17 CF, 17 LC, 218 M, 17 E, 18 C, 97 R; 174/52 FP, 52 PE, 52 S; 113/119; 264/272

[56] References Cited

U.S. PATENT DOCUMENTS

| | | | |
|---|---|---|---|
| 2,759,223 | 8/1956 | Del Camp | 29/630 B |
| 3,021,498 | 2/1962 | Spillar | 339/18 C |
| 3,021,500 | 2/1962 | Pohl | 339/97 R |
| 3,423,516 | 1/1969 | Segerson | 174/52 FP |
| 3,500,295 | 3/1970 | Faber et al. | 339/218 M |
| 3,602,875 | 8/1971 | Pierini | 339/17 CF |
| 3,641,254 | 2/1972 | Bunting et al. | 29/626 |
| 3,889,363 | 6/1975 | Davis | 264/272 X |
| 3,939,558 | 2/1976 | Riley | 174/52 PE |
| 3,981,074 | 9/1976 | Yamamoto et al. | 264/272 X |
| 4,045,869 | 9/1977 | Hartmann et al. | 29/629 |
| 4,056,299 | 11/1977 | Paige | 339/218 R |
| 4,127,934 | 12/1978 | Bartley et al. | 29/626 |

FOREIGN PATENT DOCUMENTS

| | | | |
|---|---|---|---|
| 1289899 | 2/1969 | Fed. Rep. of Germany | 339/17 LC |
| 1540534 | 1/1970 | Fed. Rep. of Germany | 339/17 LC |
| 1004263 | 9/1965 | United Kingdom | 29/630 B |

*Primary Examiner*—Ervin M. Combs

[57] ABSTRACT

A method of producing a structure of connection terminals with contacts includes a step of forming a synthetic resin by molding with a comb-shaped intermediate material buried therein such that end portions of the terminals of the intermediate are left unburied and cutting off the portion of the intermediate material connecting the terminals from the terminals.

6 Claims, 7 Drawing Figures

METHOD OF PRODUCING A STRUCTURE OF CONNECTION TERMINALS

BACKGROUND OF THE INVENTION

This invention relates to a method of producing a structure of connection terminals having contacts to which counterpart contacts are abutted to make electric connection.

FIGS. 1 and 2 jointly show a conventional structure of connection terminals. As shown in the drawing, a desired number of terminals 12 are arranged in a parallel relationship on the back plane of an elongated insulation substrate 11. One end of each terminal is fixed to the substrate 11 by a rivet 13 in a manner that the top end 13*a* of the rivet is exposed from the surface of the substrate 11 to provide a contact. The insulation substrate is to be fixed to a suitable position of an instrument, a device, etc. by suitable means such as screws, and a lead wire 14 is connected to the other end of each terminal 12.

The structure of this type gives rise to the following difficulties. First of all, a large number of manufacturing steps are required because the contact pieces or terminals are fixed to the insulation substrate one by one. It is also difficult to determine accurately the location of each contact piece. Namely, the contact pieces tend to be apart from one another irregularly, presenting a difficulty with respect to the mass production of the structure. Further, the structure itself of connection terminals comprises a large number of parts, resulting in complicated construction and high manufacturing cost. An additional difficulty to be noted is that the contact piece fixed to the back plane of the insulation substrate is exposed to the atmosphere over the entire length thereof. Thus, where the connection terminal structure is incorporated into an instrument or a device, the contact piece is likely to get in touch with another conductive member.

SUMMARY OF THE INVENTION

An object of this invention is to provide a method of producing a structure of connection terminals, capable of simplifying the manufacturing steps and suitable for mass production of structures simple in construction and uniform in quality.

BRIEF DESCRIPTION OF THE DRAWING

FIGS. 1 and 2 jointly show a conventional structure of connection terminals, wherein FIG. 1 is a plan view and FIG. 2 is a cross sectional view along the line 2—2 of FIG. 1;

DETAILED DESCRIPTION OF THE PREFERRED EMBODIMENT

Described in the following is a method of producing a structure of connection terminals according to one embodiment of this invention with reference to FIGS. 3 to 6.

Figure 1:
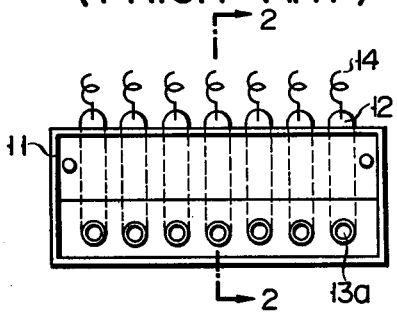
FIG. 1 (PRIOR ART)
Figure 2:
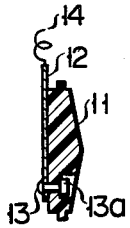
FIG. 2 (PRIOR ART)
Figure 3:
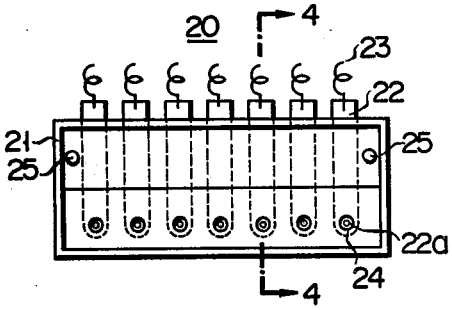
FIG. 3 is a plan view of a structure of connection terminals produced by a method according to one embodiment of this invention.
Figure 4:
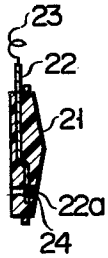
FIG. 4 is a cross sectional view along the line 4—4 of FIG. 3.

FIGS. 3 and 4 jointly show a connection terminal structure 20 produced by the invented method. A reference numeral 21 denotes an elongated flat synthetic resin substrate exhibiting an electric insulation property. A large number of contact pieces or terminals 22 are embedded in the substrate 21 at a predetermined interval. It is seen that one end portion of each contact piece 22 extends from the substrate and a lead wire 23 is connected to the extending one end portion. An opening 24 is formed on the surface region of the substrate 21 so as to expose the other end portion of the contact piece 22 to the atmosphere, the exposed portion providing a contact 22*a*.

Figure 5:
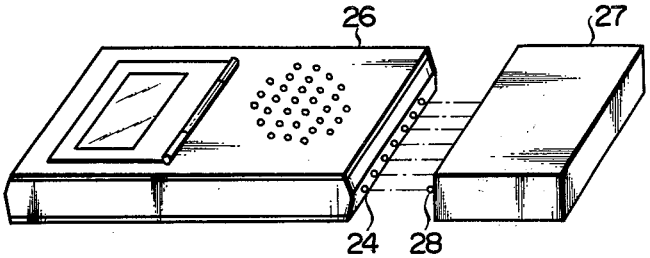
FIG. 5 is an oblique view of a tape recorder into which the structure of FIGS. 3 and 4 is incorporated.

Through-holes 25 are formed on the upper right-hand end and left-hand end portions of the insulation substrate 21. By using these holes 25, the connection terminal structure 20 is fitted to a desired instrument like, for example, a small tape recorder 26 as shown in FIG. 5. In this case, the insulation substrate 21 constitutes the edge plate of the casing of the tape recorder and the lead wires 23 are connected to predetermined parts and points of the tape recorder. Fittings such as a radio tuner 27 are mounted to one side of the tape recorder 26 as required. FIG. 5 shows that contact terminals 28 resiliently project from one side of the radio tuner 27. When the radio tuner is mounted to the tape recorder, these terminals 28 are pressed against the contact terminals 22*a* of the connection terminal structure 20, thereby achieving electric connection between the tape recorder 26 and the radio tuner 27. Naturally the integral body thus provided is used as a radio.

Figure 6:
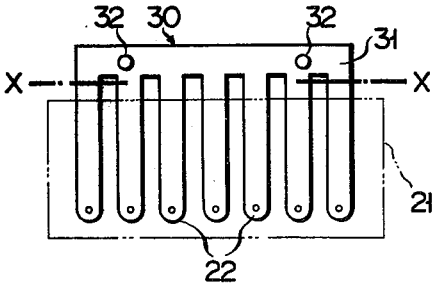
FIG. 6 is a plan view of an intermediate material used for the production of the structure of FIGS. 3 and 4.

FIG. 6 is intended to explain the manufacturing method of the connection terminal structure of the construction described above. A reference numeral 30 denotes an intermediate material prepared by punching a conductive plate of metal into a comb-shape. It is seen that a plurality of contact pieces or terminals 22, seven contact pieces in this case, are arranged at a predetermined interval and joined together at the end by a common connection portion 31. Namely, the base portion of the comb is to constitute the connection portion 31 and the teeth of the comb are to provide the contact pieces 22. Holes 32 are formed in the connection portion 31 as shown in FIG. 6 in the punching step of the conductive plate or after the punching.

The synthetic resin substrate 21 having the contact pieces 22 buried therein is then formed by molding an electrically insulating synthetic resin integrally with the contact pieces 22 of the intermediate material 30. In this molding step, the contact pieces 22 are partly left unburied in the synthetic resin. Namely, the synthetic resin is molded into a shape as shown by two dots-dash lines in FIG. 6. The holes 32 formed in the connection portion 31 act as the criterion for accurately determining the location of the intermediate material 30 disposed in the mold (not shown) in the molding step. The through-holes 25 formed in the substrate 21 may be bored in or after the molding step.

After the resin has been hardened, the connection portion 31 of the intermediate material 30 is cut off from the contact pieces 22. Naturally, the ends of the contact pieces from which the connection portion has been cut off constitute terminals to which lead wires are connected. It is preferred that the connection portion 31 be cut off along a straight line parallel with the edge of the substrate as indicated by an X—X line in FIG. 6. In this case, the exposed portions or the entire lengths of the contact pieces are all substantially equal. Of course, it may be sometimes necessary to render the lengths and the shapes of the exposed portions differing from one another. In such a case, the connection portion 31 need not be cut off along a straight line.

As described previously, openings 24 are formed in the surface region of the substrate 21 so as to expose the buried ends of the contact pieces 22 to the atmosphere and provide contacts 22*a*. It is convenient to form the openings 24 in the molding step of the substrate, though the openings 24 may also be formed after the molding step. It follows that the mold used in the preferred embodiment of this invention is capable of forming the holes 25, which are used in mounting the connection terminal structure to an instrument, and the openings 24 as well as forming the configuration of the substrate. Finally, lead wires 23 are connected to the unburied ends of the contact pieces 22 by soldering or the like, thereby providing the connection terminal structure 20 shown jointly in FIGS. 3 and 4.

As described in detail, the method of this invention comprises a step of forming an insulation substrate by molding a synthetic resin with a large number of contact pieces buried therein. In contrast, contact pieces are fixed to the substrate one by one with rivets in the prior art. Clearly, this invention permits simplifying the manufacturing steps, leading to a markedly improved productivity. The invented method also comprises a step of cutting off the connection portion 31 of the intermediate material 30 after the molding step of the substrate. Namely, the connection portion 31 is cut off after the resin and the contact pieces have been integrally molded to form the substrate, resulting in that the contact pieces are arranged just at a predetermined interval.

It is also important to note that the holes 32 formed in the connection portion 31 of the intermediate material 30 provide a good criterion for accurately determining the location of the intermediate material 30 disposed in the mold in the molding step. Accordingly, the locations of the contact pieces 22 relative to the substrate 21 can also be determined easily and highly accurately, permitting the products of uniform quality. Further, the disuse of rivets for fixing the contact pieces 22 to the substrate 21 is effective for reducing the number of required parts and simplifying the construction of the connection terminal structure. An additional merit to be noted is that almost entire portion of each contact piece 22 is buried within the substrate 21 except the tip portion to which the lead wire 23 is connected. Thus, it is substantially impossible that the contact piece gets in touch with another conductive member when the connection terminal structure is incorporated into an instrument or a device.

In the embodiment described, the intermediate material 30 consisting of the contact pieces 22 and the connection portion 31 was prepared by punching a conductive plate. But, the method of preparing the intermediate material is not restricted to the one described. For example, the intermediate material may be prepared by arranging first a plurality of contact pieces in a predetermined fashion, followed by allowing one end of each contact piece to be fixed to a common connection member. In this case, a holder capable of holding all the contact pieces at one end can be used as a suitable connection member.

Figure 7:
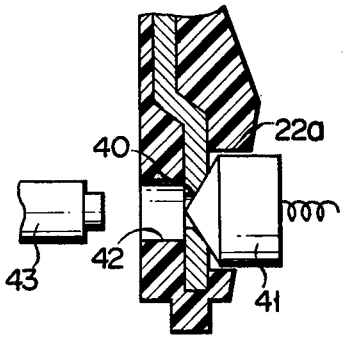
FIG. 7 shows a further embodiment, which illustrates means to support each terminal during the molding steps.

An additional feature should be noted concerning the embodiment described, namely, a small hole 40 is formed at the contact 22*a* of each of the terminals 22 as shown in FIG. 7 in a magnified state. A contact 41 having a sharp edge is pressed into the hole 40 so as to ensure the electric connection between these contacts 22*a* and 41. Further, the hole 40 is effective for ensuring an accurate location of each terminal in the molding step. Namely, it is possible to support each terminal in the molding step by inserting a pin 43 through the hole 40. The pin 43 is removed after the molding. Naturally, a hole 42 is formed in that portion of the insulation substrate 21 which corresponds to the hole 24 for exposing the contact 22*a* to the atmosphere.

What is claimed is:

1. A method of producing a structure of connection terminals having a plurality of contacts to which counterpart contacts are pressed to make electrical connection, comprising the steps of preparing an intermediate material having a plurality of contact pieces and a connection portion integrally formed with the contact pieces, one end of each of the contact pieces providing a contact and having a hole and the other being joined to the connection portion, supporting the intermediate material by inserting a pin in the hole of the contact piece, one end of said pin having a smaller diameter portion for insertion into said hole and a larger diameter portion forming a face which contacts a face of said contact piece, forming an insulation substrate having two through holes which are coaxial with and of larger diameter than the hole in said contact piece, each of said through holes being disposed on an opposite face of said contact piece, by molding an electrically insulating synthetic resin with the intermediate material buried therein such that the other ends of the contact pieces are left unburied, and removing the pin from the hole and cutting off the connection portion of the intermediate material from the contact pieces, whereby to provide a plurality of exposed outer contact pieces and a plurality of resilient exposed inner contact pieces, positioned about said contact piece holes on opposite faces of said contact pieces, which are separated by said insulating resin.

2. The method according to claim 1, wherein said hole is circular.

3. The method according to claim 2, wherein the counterpart contacts have sharp edges which are pressed into the holes.

4. The method according to claim 3, wherein the other ends of the contact pieces which are left unburied are connected to electrical wires, respectively.

5. The method according to claim 1, wherein a portion of the contact piece to be embedded in the substrate is bent to prevent it from slipping longitudinally and out of the substrate.

6. The method according to claim 2, wherein the counterpart contacts are tapered at the ends thereof to be inserted into the holes formed to make electrical contact.

* * * * *